US008408973B2

(12) United States Patent
Grabsch et al.

(10) Patent No.: US 8,408,973 B2
(45) Date of Patent: Apr. 2, 2013

(54) FINISHING APPARATUS WITH RESILIENTLY MOUNTABLE FINISHING BELT GUIDE

(75) Inventors: Peter Grabsch, Oberwolfach (DE); Michael Huber, Bad Rippoldsau (DE); Simon Wolber, Wolfach (DE); Johannes Herrmann, Bad Rippoldsau (DE); Oliver Hildebrandt, Hornberg (DE)

(73) Assignee: Supfina Grieshaber GmbH & Co. KG, Wolfach (DE)

( * ) Notice: Subject to any disclaimer, the term of this patent is extended or adjusted under 35 U.S.C. 154(b) by 351 days.

(21) Appl. No.: 12/869,412

(22) Filed: Aug. 26, 2010

(65) Prior Publication Data

US 2011/0306281 A1 Dec. 15, 2011

(51) Int. Cl.
*B24B 21/00* (2006.01)
*B24B 21/16* (2006.01)

(52) U.S. Cl. ..... 451/302; 451/303; 451/168; 451/49

(58) Field of Classification Search ..... 451/168, 451/251, 296, 303, 304, 307, 49, 489, 62, 451/302, 318, 317, 313; *B24B 21/00, 21/02, B24B 35/00, 5/42*

See application file for complete search history.

(56) References Cited

U.S. PATENT DOCUMENTS

| | | | | |
|---|---|---|---|---|
| 2,835,086 | A * | 5/1958 | Longmire et al. | 451/415 |
| 3,634,982 | A * | 1/1972 | Martin | 451/526 |
| 3,715,839 | A * | 2/1973 | Heesemann | 451/168 |
| 4,682,444 | A * | 7/1987 | Judge et al. | 451/49 |
| 4,979,335 | A * | 12/1990 | Weber et al. | 451/324 |
| 4,993,191 | A * | 2/1991 | Judge et al. | 451/317 |
| 5,683,291 | A * | 11/1997 | Humpert et al. | 451/168 |
| 5,695,391 | A * | 12/1997 | Steinwender | 451/168 |
| 5,730,647 | A * | 3/1998 | Becker et al. | 451/173 |
| 5,755,615 | A * | 5/1998 | Kiriyama | 451/190 |
| 5,775,974 | A * | 7/1998 | Hulsebus | 451/28 |
| 5,775,978 | A * | 7/1998 | Brocksieper et al. | 451/51 |
| 6,080,051 | A * | 6/2000 | Weber | 451/303 |
| 6,203,402 | B1 * | 3/2001 | Hildebrandt | 451/8 |
| 2001/0041523 | A1 * | 11/2001 | Bonachera et al. | 451/307 |
| 2004/0157530 | A1 * | 8/2004 | Omata et al. | 451/5 |

(Continued)

FOREIGN PATENT DOCUMENTS

| | | | |
|---|---|---|---|
| DE | 29819442 | U1 * | 1/1999 |
| DE | 38 13 484 | | 11/1999 |

(Continued)

OTHER PUBLICATIONS

Search Report EP 09 01 4666.

*Primary Examiner* — Lee D Wilson
*Assistant Examiner* — Tyrone V Hall, Jr.
(74) *Attorney, Agent, or Firm* — Brinks Hofer Gilson & Lione

(57) ABSTRACT

The disclosure relates to a finishing apparatus for finish machining of rotationally symmetric workpiece surfaces having a finish belt guide which has a guiding body for guiding the finish belt, wherein the guiding body comprises a shell-like guiding surface along which the finish belt can be guided or is guided between an insertion end of the finish belt and a withdrawal end of the finish belt, wherein the guiding surface is mounted in a resiliently elastic manner in the radial direction, wherein, when seen in the circumferential direction, the guiding surface extends in a continuous manner between the insertion end of the finish belt and the withdrawal end of the finish belt over at least a part of the width of said guiding surface and is mounted in a resiliently elastic manner.

15 Claims, 5 Drawing Sheets

U.S. PATENT DOCUMENTS

Figure 1:
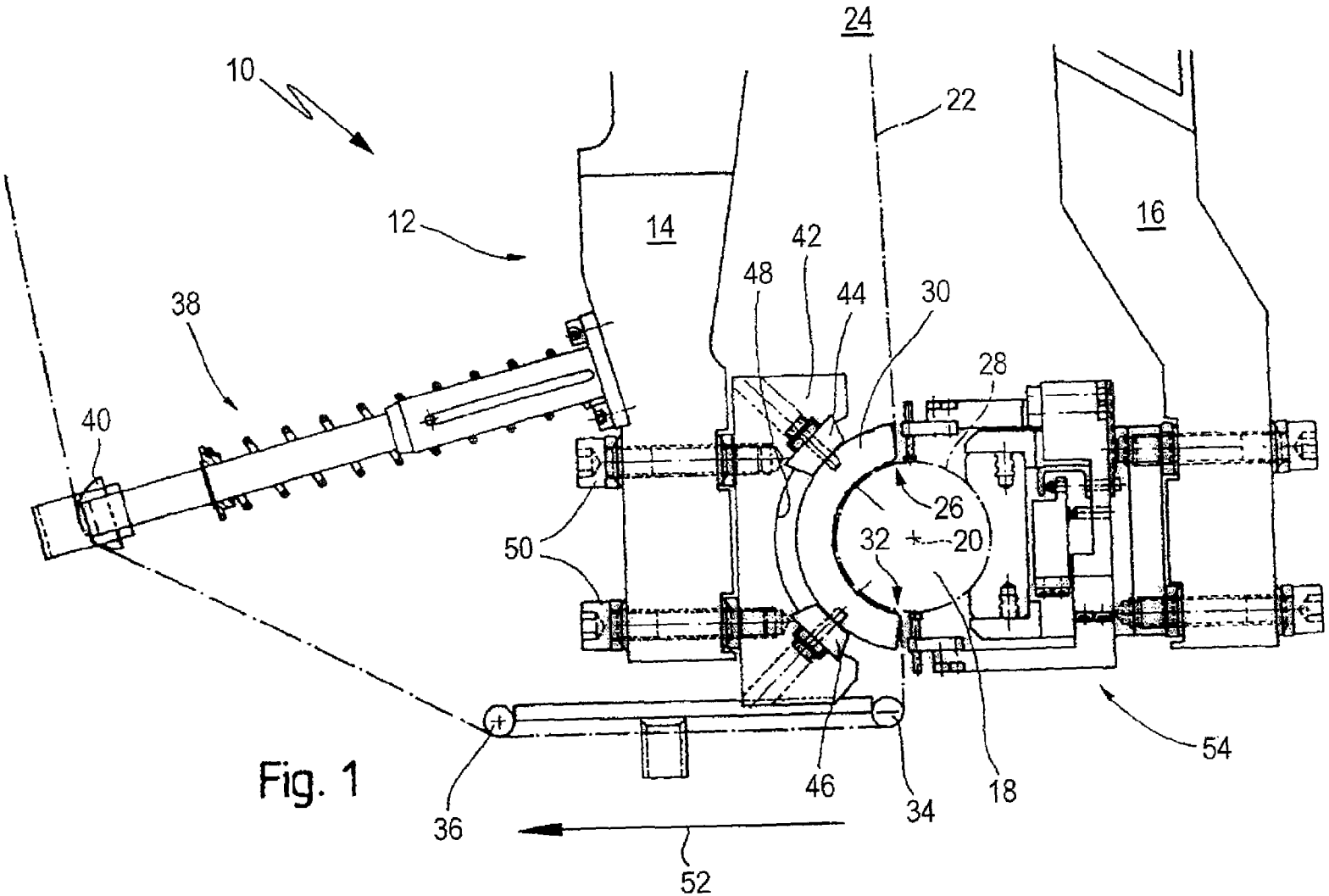

2010/0248602 A1 * 9/2010 Kakizawa et al. ..... 451/540

FOREIGN PATENT DOCUMENTS

DE 102007051047 A1 * 4/2009
EP 0 913 232 5/1999
EP 0 781 627 3/2000
EP 1 053 826 11/2000
FR 2901500 A1 * 11/2007
JP 2004106128 A * 4/2004

* cited by examiner

FINISHING APPARATUS WITH RESILIENTLY MOUNTABLE FINISHING BELT GUIDE

CROSS-REFERENCE TO RELATED APPLICATIONS

This application claims the benefit of EP 09 014 666.3-2302 filed on Nov. 25, 2009. The disclosure of the above application is incorporated herein by reference.

FIELD

The present disclosure relates to a finishing apparatus for finish machining of rotationally symmetric workpiece surfaces.

BACKGROUND

The statements in this section merely provide background information related to the present disclosure and may not constitute prior art.

An apparatus for fine machining the crank pins of crankshafts having a half shell for guiding a honing belt which is guided at segments of a guiding surface that are separated from one another in the circumferential direction is known from DE 38 13 484 A1. A machining shell shaped as an expandable clamping shoe having a cavity filled with a pressure medium is known from EP 0 781 627 A1.

The above-mentioned apparatuses at least in part allow compensating deviations from the specified dimensions of a workpiece to be machined. Compared to likewise known rigid guiding bodies, better concentricity values are generated.

SUMMARY

The present disclosure provides a finishing apparatus for finish machining of rotationally symmetric workpiece surfaces, with a finish belt guide having a guiding body for guiding a finish belt, wherein the guiding body comprises a shell-like guiding surface along which the finish belt can be guided between an insertion end of the finish belt and a withdrawal end of the finish belt, the guiding surface being mounted in a resiliently elastic manner in the radial direction.

As such, the present disclosure improves on a finishing apparatus of the type mentioned above such that it allows an excellent adaptation to the shape of a workpiece and generates excellent concentricity values.

According to the present disclosure, this is attained with a finishing apparatus of the type mentioned above in that, when seen in the circumferential direction, the guiding surface extends in a continuous manner between the insertion end of the finish belt and the withdrawal end of the finish belt over at least a part of the width of said guiding surface and is mounted in a resiliently elastic manner.

In the finishing apparatus according to the present disclosure, when seen in the circumferential direction, the guiding surface extends continuously between the insertion end of the finish belt and the withdrawal end of the finish belt. In this region, the finish belt is guided at least across part of the width of the guiding surface such that, unlike DE 38 13 484 A1, it is not divided into individual segments. As a result of this, an improvement of the concentricity values is achieved. Furthermore, when seen in the circumferential direction, the guiding surface is mounted in a resiliently elastic manner along its entire course between the insertion end of the finish belt and the withdrawal end of the finish belt. This includes a resilient mounting of a guiding surface section at the end side which, unlike EP 0 781 627 A1, is likewise mounted in a resiliently elastic manner in the radial direction. The mounting described in EP 0 781 627 A1 requires that, for completing the cavity in the region of the end side and also lateral guiding surface sections, a stable wall is provided which prevents a resilient mounting from acting in the radial direction.

In the finishing apparatus according to the present disclosure, the deformation or displacement in the radial direction of an end side guiding surface section is accompanied by a deformation or displacement of a central guiding surface section in the opposite direction. This allows an excellent adaptation of the guiding surface, even to workpieces with too large or too small diameters. As a result of this deformability of the continuous guiding surface, excellent concentricity values are achieved.

A particularly good adaptability of the guiding surface is obtained, if the guiding body is made of a resiliently elastic material.

An advantageous form of the disclosure provides that at least one slot extending in the circumferential direction is provided for mounting the guiding surface in the guiding body in a resiliently elastic manner. This slot advantageously extends across the entire width of the guiding body.

It is particularly advantageous if a first slot is provided which, when seen radially outward from the guiding surface, is arranged adjacent to the guiding surface and, when seen in the circumferential direction, is closed at both ends of the slot. Thus the first slot does not extend up to the insertion end of the finish belt and to the withdrawal end of the finish belt, but is spaced apart from these ends.

Particularly good deformation behavior of the guiding surface results if a second slot is provided which is spaced farther apart from the guiding surface in the outward radial direction than the first slot, the second slot being open-edged at one of its ends and closed at the opposite end. Thus the second slot is open in the region of the insertion end of the finish belt or of the withdrawal end of the finish end, so that an end side guiding surface section of the guiding surface is deformed or displaced by changing the slot geometry of the second slot.

Further optimization of the deformation behavior of the guiding surface results if the second slot, when seen in the circumferential direction, overlaps the first slot along part of its path. This ensures that the deformability or displaceability of an end side guiding surface section is also accompanied by a modification of the slot geometry of the first slot, so that guiding surface sections adjacent to the end side guiding surface section, in particular central guiding surface sections, can deform or shift in the opposite direction.

In one form, a third slot is provided which is spaced farther apart from the guiding surface in the outward radial direction than the first slot, the third slot being open-edged at one of its ends and closed at the opposite end. It is also advantageous in this case if the third slot, when seen in the circumferential direction, overlaps part of the first slot along its path.

If a second as well as a third slot is provided, end side guiding surface sections facing away from one another can be arranged in a resiliently elastic manner in the radial direction in a particularly simple way. This applies, in particular, if the edge-open slot ends of the second slot and of the third slot are arranged facing away from one another.

In another form, the second slot and the third slot are at the same radial distance from the guiding surface, so that a uniform deformation behavior of the guiding surface is achieved in the circumferential direction.

According to another form of the disclosure, at least one additional spring element is provided which is arranged in at least one of the slots. With such a spring element, the spring stiffness of the resilient mounting can be specified very accurately. In this case, a spring force which is determined by the pretension and selection of the spring constant of the spring element is superimposed on the deformation resistance of the guiding body. A guiding body having variable spring stiffness in the radial direction can thus be provided by exchanging such a spring element.

In one form, the spring element is held in a holding space adjacent to the slot border of a slot and whose cross section is widened in comparison with the slot cross section. This allows a spring element to be mounted in a simple and reliable way.

In still another form, at least one through hole extending across part of the width of the guiding surface is provided in the guiding surface. The through hole can be configured in the form of a pouch-shaped recess in the guiding body, or in the form of a material recess open radially outward. The through hole allows varying the contact pressure acting on the finish belt across the width of the guiding surface. Thus, it is in particular possible to produce convex workpiece surfaces, for example for crankshaft pins and main bearings.

Preferably, the through hole is arranged centered in relation to the width of the guiding surface, so that a symmetric geometry can be generated in the transverse direction. In addition, a lateral deviation of the finish belt is prevented.

Another form of the disclosure provides that the shell-like guiding surface has a concave principal curvature matching the shell shape, and that the shell-like guiding surface, when seen across at least part of the width of the guiding surface, has an additional angular, in particular perpendicular, curvature relative to the principal curvature. The guiding surface is therefore not only curved around a first axis extending parallel to the width-wise direction of the guiding surface, but additionally around an angular, in particular perpendicular, axis relative to the first axis. Such a "doubly curved" guiding surface allows particularly precise and, at the same time, quick finish machining of a rotationally symmetric but not perfectly cylindrical workpiece surface.

In another form, the principal curvature and the additional curvature have identical centers of curvature. This makes finish machining of a spherical workpiece surface possible.

Further areas of applicability will become apparent from the description provided herein. It should be understood that the description and specific examples are intended for purposes of illustration only and are not intended to limit the scope of the present disclosure.

DRAWINGS

Figure 2:
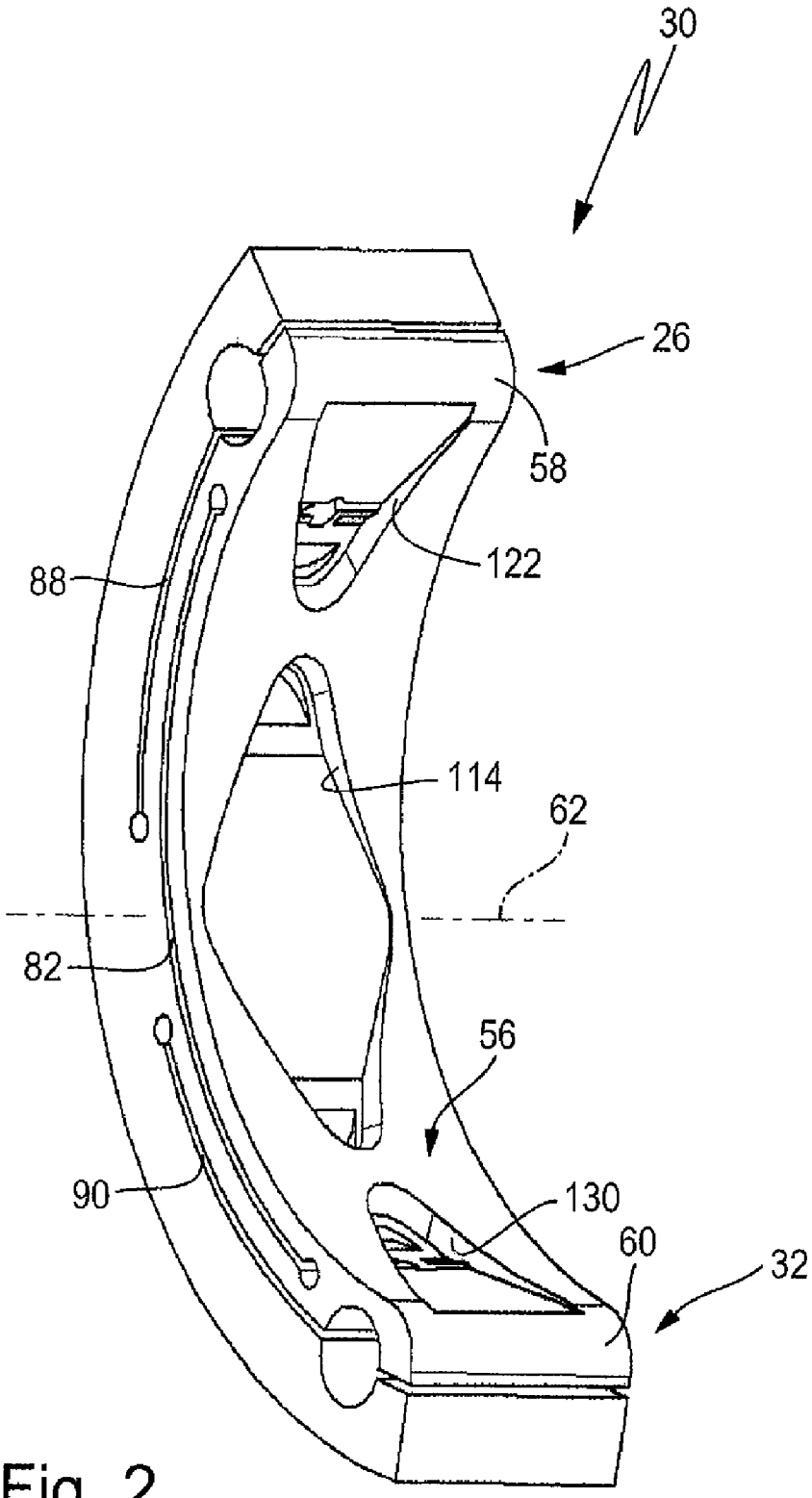
Figure 3:
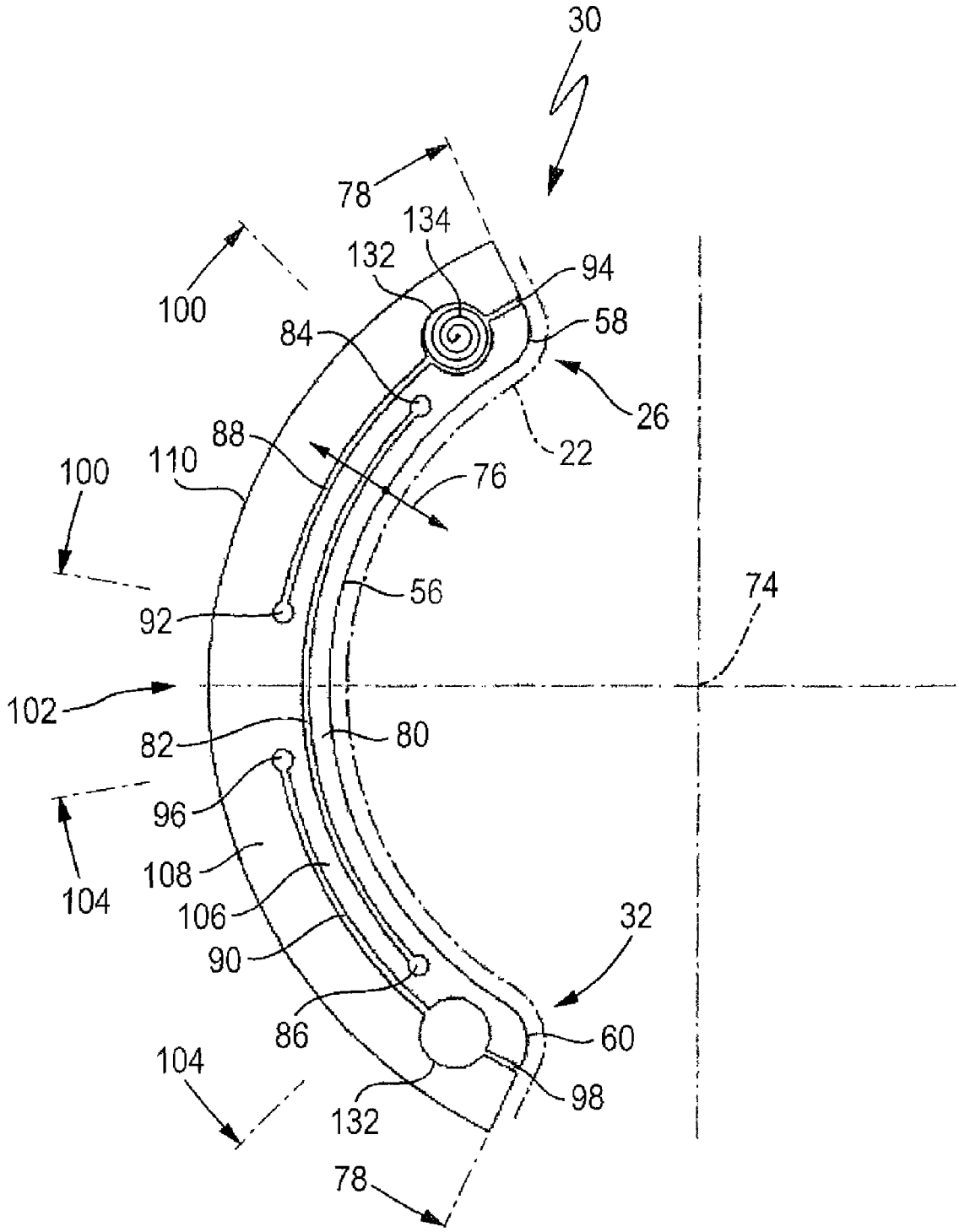
Figure 4:
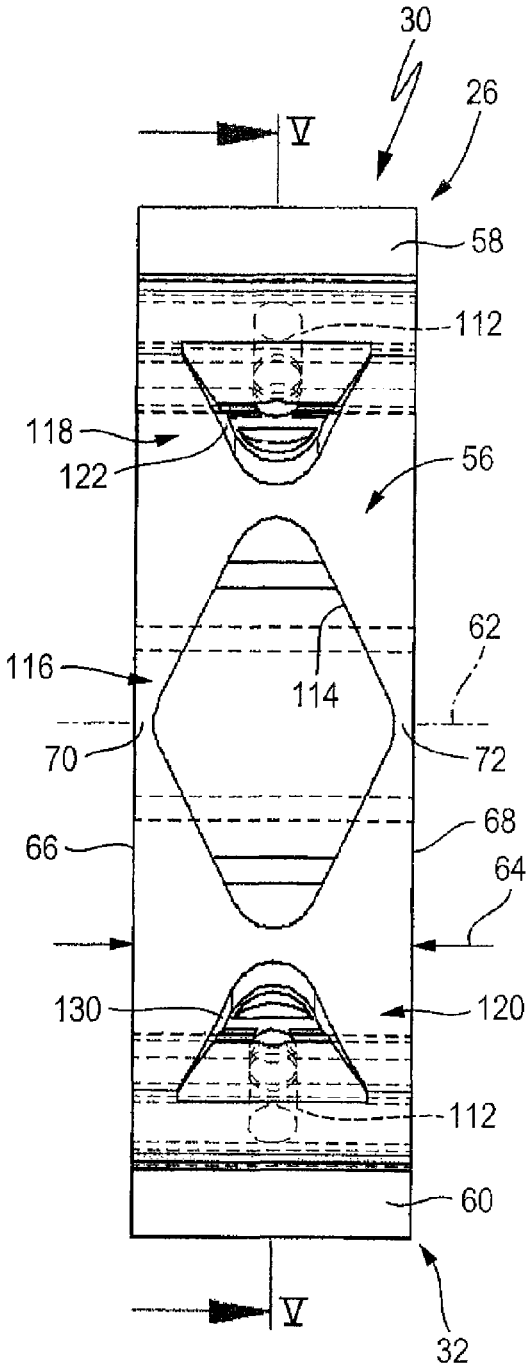

In order that the disclosure may be well understood, there will now be described various forms thereof, given by way of example, reference being made to the accompanying drawings, in which:

FIG. 1: a side view of an embodiment of a finishing apparatus with a schematically shown guiding body;

FIG. 2: a perspective view of the guiding body according to FIG. 1;

FIG. 3: a side view of the guiding body according to FIG. 1;

FIG. 4: a front view of the guiding body according to FIG. 1; and

Figure 5:
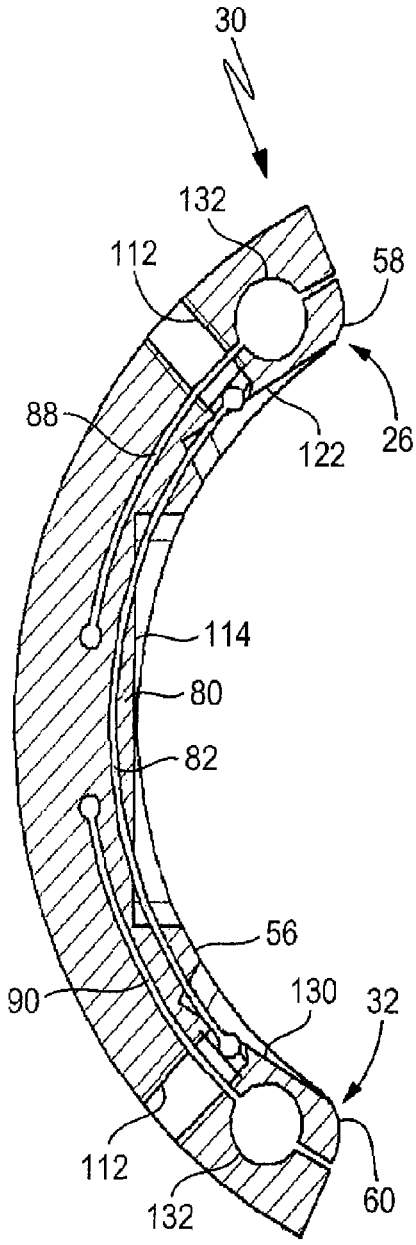
Figure 6:
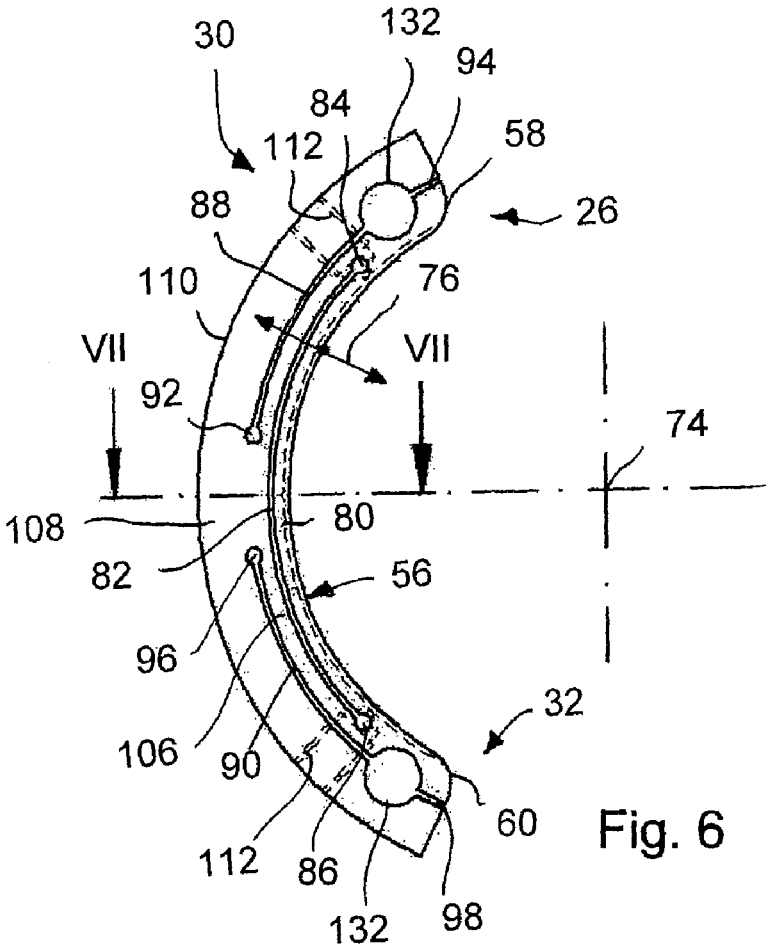

FIG. 5: a side view of the guiding body according to FIG. 1 along a cut line marked V-V in FIG. 4;

FIG. 6: a side view of another embodiment of a guiding body; and

Figure 7:
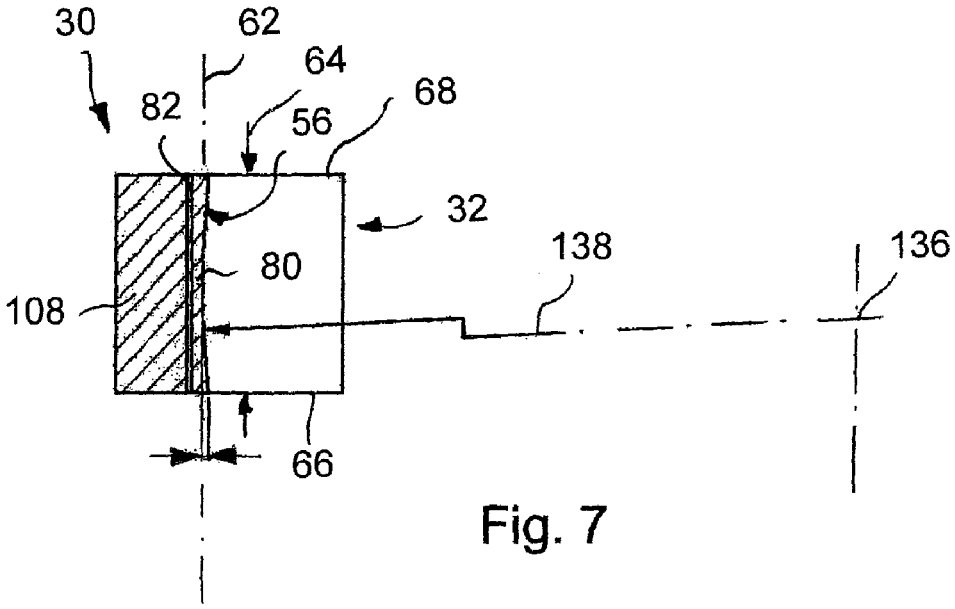

FIG. 7: a top view of the guiding body according to FIG. 6 along a cut line marked VII-VII in FIG. 6.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

A finishing apparatus according to the present disclosure is overall designated by reference numeral 10 in FIG. 1. The finishing apparatus 10 comprises a pincer 12 with a first arm 14 and a second arm 16. The arms 14 and 16 are pivotably mounted so that they can be moved in the direction of a rotationally symmetric workpiece 18 (as shown in FIG. 1).

The workpiece 18 is, for example, a crankshaft whose pin or main bearing has to be finish machined.

The finishing apparatus 10 further comprises a finish belt 22 which is shown with a dot-dashed line in FIG. 1. The finish belt 22 is provided from a finish belt stock 24, fed radially onto the workpiece 18 and brought into contact with a cylindrical workpiece surface 28 of the workpiece 18 in the region of the insertion end 26 of the finish belt. Starting at the insertion end 26 of the finish belt, the finish belt 22 is guided between a guiding body 30 and the workpiece surface 28 up to a withdrawal end 32 of the finish belt. In the region of the withdrawal end 32 of the finish belt, the finish belt is guided away radially outward from the workpiece 18 by the workpiece surface 28.

The finish belt 22 is guided along its path by means of the deflection rollers 34 and 36 and tensioned by means of a tensioning device 38. The tensioning device 38 has a tensioning element 40 acting on the finish belt 22 which at the same time acts as a deflection element. The tensioning device 38 is firmly connected to the first arm 14 of the pincer 12.

The guiding body 30, which is only shown schematically in FIG. 1, is fixed to a guiding body holder 42, in particular, by means of two fastening elements 44 and 46 which can be screwed to the guiding body 30. The guiding body holder 42 has a surface 48 facing the guiding body 30 which has a concave curvature matching the shape of the guiding body 30. The guiding body 42 is fixed to the first arm 14, in particular, by means of a screw joint 50.

During the finish machining process, the workpiece 18 is rotatably driven by means of a drive mechanism (not shown) about the workpiece axis 20. In this case, the finish belt 22 can be stationary, or it is moved in an advance direction 52 in order to increase the cutting speed during the machining process of the workpiece surface 28. While the workpiece 18 is machined, the diameter and/or concentricity of the workpiece 18 can be measured, if necessary, by means of a measuring mechanism 54 which is attached to the second arm 16.

The design of the guiding body 30 will hereinafter be described with reference to FIGS. 2 to 5.

In order to guide the finish belt 22, the guiding body 30 has a shell-like guiding surface 56 which extends between the insertion end 26 of the finish belt and the withdrawal end 32 of the finish belt. In the region of the insertion end 26 of the finish belt, the guiding surface 56 continuously merges into an insertion surface 58 of the finish belt. In the region of the withdrawal end 32 of the finish belt, the guiding surface 56 continuously merges into a withdrawal surface 60 for the finish belt.

The guiding surface 56 has a width 64 parallel to the width-wise direction 62 (cf. FIG. 4). Adjacent to a first lateral surface 66 and a second lateral surface 68, the guiding surface 56 has parts 70 and 72 in which the guiding surface 56, when seen in the circumferential direction, is continuous and not interrupted between the insertion surface 58 and the withdrawal surface 60.

The guiding surface 56 has a center of curvature 74, cf. FIG. 3. The guiding surface 56 is mounted in a resiliently elastic manner along its entire path between the insertion surface 58 and the withdrawal surface 60 in the radial direction 76 with reference to the center of curvature 74.

With respect to the center of curvature 74, the guiding body 30 extends over an angle 78 which preferably is greater than 90° and smaller than 180°, in particular between approximately 110° and approximately 160°.

The guiding body 30 is in particular configured in one piece and has different guiding body sections. A first guiding body section 80 forms the guiding surface 56 on its outer surface. The first guiding body section 80 is bounded radially outward by a first slot 82 which extends across the entire width 64 of the guiding body 30. The first slot 82 extends in the circumferential direction between a first slot end 84 and a second slot end 86. The slot ends 84 and 86 are closed. The first slot end 84 is spaced apart from the insertion end 26 of the finish belt. The second slot end 86 is spaced apart from the withdrawal end 32 of the finish belt.

The guiding body 30 further comprises a second slot 88 and a third slot 90 which extend across the entire width 64 of the guiding body 30. Starting at a closed slot end 92, the second slot 88 extends in the direction of the insertion end 26 of the finish belt and is edge-open at its slot end 92 facing away from slot end 94.

The third slot 90 extends between a closed slot end 96 and an edge-open slot end 98 which is provided in the region of the withdrawal end 32 of the finish belt.

The second slot 88 and the third slot 90 extend coaxially to the first slot 82. With reference to the first slot 82, the second slot 88 and the third slot 90 are arranged radially farther outward and have the same radial distance to the first slot 82. The closed slot ends 92 and 96 of the second slot 88 and/or of the third slot 90 face one another and are spaced apart from one another.

The first slot 82 and the second slot 88 are arranged overlapping one another in the circumferential direction, namely in a partial region 100 which, when seen in the circumferential direction, is spaced apart from the insertion end 26 of the finish belt and from the central section 102 of the guiding body 30. Similarly, the first slot 82 and the third slot 90 overlap one another in a partial region 104 which is spaced apart from the withdrawal end 32 of the finish belt and from the central section 102.

The second guiding body section arranged between the first slot 82 and the second slot 88 and/or third slot 90 is designated with reference numeral 106. The guiding body 30 further has a third guiding body section 108 which extends between the second slot 88 and the third slot 90 on one side and an outer surface 110 of the guiding body 30 facing away from the guiding surface 56 on the other end.

In order to fasten the guiding body 30, it has two bores 112 extending in the radial direction (cf. FIGS. 4 and 5) which are preferably provided with an inner thread for screwing the fastening elements 44 and/or 46.

The guiding surface 56 has a plurality of through holes which extend across part of the width 64 of the guiding surface 56. A first through hole 114 is arranged in the region of a central guiding surface section 116. The through hole 114 is in particular configured in the shape of a recess of the first guiding body section 80. The through hole 114 tapers in the direction of the insertion end 26 of the finish belt and in the direction of the withdrawal end 32 of the finish belt. In particular, the through hole 114 is diamond-shaped in the top view.

Adjacent to the central guiding surface section 116 the guiding surface 56 has a first end side guiding surface section 118 and a second end side guiding surface section 120. The guiding surface 56 is also open in the region of these guiding surface sections 118, 120, namely by means of a second through hole 122 and by means of a third through hole 130.

The through holes 122 and 130 respectively taper in the direction of the first through hole 114. In particular, the through holes 122 and 130 have an approximately triangular shape in the top view.

The guiding body 30 further has holding spaces 132 that are respectively arranged adjacent to the insertion end 26 of the finish belt and to the withdrawal end 32 of the finish belt. They have a cylindrical profile and respectively border with their partially cylindrical bordering surfaces on the bordering surfaces of the second slot 88 and of the third slot 90. The holding spaces 132 hold a spring element 134 which is schematically shown in FIG. 3. The spring element 134 is, for example, a spiral spring which acts with a spring force on the first guiding body section 80 and on the third guiding body section 108 in opposing radial directions.

The guiding body 30 allows a particularly good adaptation of the path of the finish belt 22 to the path of the workpiece surface 28. The end side guiding surface sections 118 and 120 are mounted in a resiliently elastic manner in the radial direction by the edge-open configuration of the slot ends 94 and 98. The deformation or displacement of the end side guiding surface sections 118 or 120 causes a relative deformation or displacement of the central guiding surface section 116 in the opposite radial direction. This is in particular achieved by the alternating change of the arrangement of the slots 82, 88 and 90 (in the partial regions 100 and 104), which overlap one another in the circumferential direction, and the non-overlapping arrangement of the slots 82, 88 and 90 (in the remaining partial regions).

Similarly, the displacement or deformation of the central guiding surface section 116 causes the displacement or deformation of the end side guiding surface sections 118 and 120 in the opposite radial direction.

The described geometry of the through holes 114, 122 and 130 further allows a spherical, other than cylindrical, finishing of the workpiece surface 28.

The guiding body 30 overall makes it possible to apply the entire workpiece surface 28 to the guiding surface 56, whereby the diameter of the workpiece 18 can fluctuate within a comparatively large belt width. Undesired linear contacts between the guiding surface 56 and the workpiece surface 28 can thus be avoided. An improvement in the concentricity of the workpiece 18 is thus achieved. During the machining process of the workpiece along its path, the guiding surface 56 adjusts to the workpiece surface 28, whose diameter is reduced by the abrasive effect of the finish belt 22 during machining. The through holes 114, 122 and 130 allow production of a workpiece geometry other than cylindrical because the finish belt 22 is pressed against the workpiece surface 28 with a lower contact pressure in the region of the through holes.

The finishing apparatus 10 according to the present disclosure also allows for compensation of variations in thickness of the finish belt 22. Spring elements 134 can be used for further influencing the resiliently elastic mounting in the radial direction of the guiding surface 56. A further adaptation can be achieved by the selection of the material for the guiding body 30 which is, for example, made of spring steel.

Another embodiment of a guiding body 30 is shown in FIGS. 6 and 7. It has a design similar to the guiding body 30 described above with reference to FIGS. 2 to 5. Therefore, only the differences between the guiding body 30 according to FIGS. 6 and 7 and the guiding body 30 according to FIGS. 2 to 5 will be dealt with below:

The guiding body 30 according to FIGS. 6 and 7 is not only curved around a first axis extending parallel to the width-wise direction 62 which extends through the center of curvature 74 (in particular, perpendicularly to the drawing plane of FIG. 6), but additionally around a second axis at an angle to the first axis which extends through another center of curvature 136 (in particular, perpendicularly to the drawing plane of FIG. 7). This way, a multiply-curved guiding surface 56 is provided.

In the embodiment shown in the drawing, the curvature around the first axis is greater than the curvature around the second axis; the center of curvature 74 is therefore less spaced apart from the guiding surface 56 than the center of curvature 136. The radius 138 of the additional curvature is selected such that a degree of curvature shown in FIG. 7 which indicates the maximum distance of the doubly curved guiding surface 56 from an (imagined) merely simply curved guiding surface 56 is between approximately 0.01 mm and approximately 0.05 mm.

In an alternative embodiment the centers of curvature 74 and 136 are identical.

In other aspects regarding the design and operation of the guiding body 30 according to FIGS. 6 and 7, reference is made to the preceding description of the guiding body 30 according to FIGS. 2 to 5.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A finishing apparatus for finish machining of rotationally symmetric workpiece surfaces having a finish belt guide which has a guiding body for guiding the finish belt, wherein the guiding body comprises a shell-shaped guiding surface along which the finish belt can be guided or is guided between an insertion end of the finish belt and a withdrawal end of the finish belt, wherein the guiding surface is mounted in a resiliently elastic manner in the radial direction, characterized in that, when seen in a circumferential direction, the guiding surface extends in a continuous manner between the insertion end of the finish belt and the withdrawal end of the finish belt over at least a part of the width of said guiding surface and is mounted in a resiliently elastic manner, and that at least one slot extending in the circumferential direction is provided in order to mount the guiding surface in the guiding body in a resiliently elastic manner, and characterized by a first slot which, when seen radially outward from the guiding surface, is arranged adjacent to the guiding surface and, when seen in the circumferential direction, is closed at both ends of the slot.

2. The finishing apparatus according to claim 1, characterized in that the guiding body is made of a resiliently elastic material.

3. The finishing apparatus according to claim 1, characterized by a second slot which is spaced farther apart from the guiding surface in the outward radial direction than the first slot, the second slot being open-edged at one of its ends and closed at the opposite end.

4. The finishing apparatus according to claim 3, characterized in that the second slot overlaps the first slot in the circumferential direction along part of its path.

5. The finishing apparatus according to claim 3, characterized by a third slot which is spaced farther apart from the guiding surface in the outward radial direction than the first slot, the third slot being open-edged at one of its ends and closed at the opposite end of the slot.

6. The finishing apparatus according to claim 5, characterized in that the third slot overlaps the first slot in the circumferential direction along part of its path.

7. The finishing apparatus according to claim 5, characterized in that the open-edged ends of the second slot and of the third slot are arranged facing away from one another.

8. The finishing apparatus according to claim 5, characterized in that the second slot and the third slot have the same distance to the guiding surface.

9. The finishing apparatus according to claim 1, characterized by at least one additional spring element which is arranged in at least one of the slots.

10. The finishing apparatus according to claim 9, characterized in that the spring element is held in a holding space which borders on a slot border of a slot, wherein the cross section of the holding space is widened in relation to a slot cross section.

11. The finishing apparatus according to claim 1, characterized in that at least one through hole extending across part of the width of the guiding surface is provided in the guiding surface.

12. The finishing apparatus according to claim 11, characterized in that the through hole is arranged centered in relation to the width of the guiding surface.

13. The finishing apparatus according to claim 1, characterized in that the shell-shaped guiding surface has a concave principal curvature corresponding to the shape of the shell, and that the shell-shaped guiding surface, when seen across at least part of the width of the guiding surface, has an additional curvature which is angular relative to the principal curvature.

14. The finishing apparatus according to claim 13, characterized in that the principal curvature and the additional curvature have identical centers of curvature.

15. The finishing apparatus according to claim 13, wherein the additional curvature is perpendicular relative to the principal curvature.

* * * * *